US007637099B2

(12) United States Patent
Ranganathan et al.

(10) Patent No.: US 7,637,099 B2
(45) Date of Patent: Dec. 29, 2009

(54) FLUID ENTRAINMENT APPARATUS

(75) Inventors: Raj P. Ranganathan, Rochester Hills, MI (US); Brent T. Deep, Sterling Heights, MI (US); Bala K. Murthy, Troy, MI (US); Thomas Stewart, Waterford, MI (US); Anthony F. Grzelakowski, Imlay City, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 346 days.

(21) Appl. No.: 11/470,286

(22) Filed: Sep. 6, 2006

(65) Prior Publication Data

US 2007/0119985 A1 May 31, 2007

Related U.S. Application Data

(60) Provisional application No. 60/728,160, filed on Oct. 19, 2005.

(51) Int. Cl.
*F01N 3/00* (2006.01)

(52) U.S. Cl. ..... 60/298; 60/317; 60/319; 60/324

(58) Field of Classification Search ..... 60/298, 60/317, 319, 320, 324; 181/259, 262, 263
See application file for complete search history.

(56) References Cited

U.S. PATENT DOCUMENTS 2,548,563 A * 4/1951 Ellis ..... 181/262
3,104,962 A * 9/1963 Duer ..... 55/302
3,875,745 A * 4/1975 Franklin ..... 60/319
4,178,760 A * 12/1979 Alf et al. ..... 60/319
4,335,575 A * 6/1982 Pagliuca ..... 60/319
4,339,918 A * 7/1982 Michikawa ..... 60/316
5,282,361 A * 2/1994 Sung ..... 60/315
5,962,822 A * 10/1999 May ..... 181/264
7,207,172 B2 * 4/2007 Willix et al. ..... 60/317
2005/0205355 A1 * 9/2005 Lin ..... 181/279
2006/0277901 A1 * 12/2006 Allegre et al. ..... 60/317

* cited by examiner

*Primary Examiner*—Tu M Nguyen

(57) ABSTRACT

A fluid entrainment apparatus is provided which operates to mix a first fluid stream with a second fluid stream. The apparatus includes first and second fluid flow conduits. The first fluid flow conduit includes a nozzle portion having a converging bore through which the first fluid is accelerated. Additionally, the second fluid flow conduit includes a nozzle portion having a converging bore, a duct portion having a generally cylindrical bore, and a diffuser portion having a diverging bore. The nozzle portion of the second fluid flow conduit is mounted with respect to the nozzle portion of the first fluid flow conduit such that an annular port is formed through which the second fluid passes to mix with the first fluid. Additional fluid mixing occurs in the duct portion and the diffuser portion. The fluid entrainment apparatus may be configured for use within a vehicle exhaust system.

12 Claims, 1 Drawing Sheet

FLUID ENTRAINMENT APPARATUS

CROSS-REFERENCE TO RELATED APPLICATIONS

This application claims priority to U.S. Provisional Patent Application No. 60/728,160 filed on Oct. 19, 2005.

TECHNICAL FIELD

The present invention relates to a fluid entrainment apparatus and, more specifically, to a fluid entrainment apparatus to cool the exhaust stream of a vehicular engine.

BACKGROUND OF THE INVENTION

Manufacturers of vehicles that employ internal combustion engines, more particularly diesel engines, are under increased pressure to comply with current and future emission standards for the release of oxides of nitrogen ($NO_X$), particularly nitrogen monoxide (NO), as well as unburned and partially oxidized hydrocarbons (HC), carbon monoxide (CO), particulate matter, and other emissions, such as hydrogen sulfide ($H_2S$) and ammonia ($NH_3$). In order to reduce the previously mentioned emissions of a diesel engine, the latter are typically operated with exhaust gas after-treatment systems through which the exhaust gas from the diesel engine flows.

Exhaust gas after-treatment systems typically include one or more after-treatment devices, such as oxidation catalysts, $NO_X$ abatement devices, diesel particulate filters (DPFs) and sulfur traps. These after-treatment devices generally require certain conditions to exist in the engine exhaust gas in order to perform optimally. More specifically, $NO_X$ abatement devices and oxidation catalysts, for example, have a relatively narrow temperature window within which the devices are activated, regenerated, or operate with high conversion efficiency. Periodically, after-treatment devices require heating beyond that provided by the exhaust gas to achieve the desired operating temperature, such as in the case of DPFs.

Additionally, DPFs periodically require a relatively high concentration of oxygen in the exhaust gas to facilitate regeneration of the particulate filter. Often, the required exhaust gas conditions cannot always be achieved during normal operation of the engine. More particularly, the exhaust gas temperature can only be influenced to a certain degree by the combustion process without the use of a source of supplemental heat, such as an electric heater in the exhaust-gas stream. The particulate matter can generally be characterized as soot that is captured and reduced by DPF. Present DPFs contain a separation medium with tiny pores that capture particles. Resistance to exhaust flow in the DPF increases as trapped material accumulates in the DPF, thereby generating an increase in exhaust backpressure. The DPF must then be regenerated to burn off the particulate matter/soot in the particulate trap to reduce the exhaust backpressure and increase exhaust flow through the DPF. A typical method of regenerating a DPF utilizes an energy source such as a burner or electric heater to encourage combustion of the particulate matter. Particulate combustion in a DPF has been found to increase the exhaust gas temperature within the vehicles exhaust system, downstream from the DPF.

SUMMARY OF THE INVENTION

A fluid entrainment apparatus is provided which operates to mix a first fluid stream with a second fluid stream. The fluid entrainment apparatus includes a first fluid flow conduit and a second fluid flow conduit. The first fluid flow conduit may include a nozzle portion having a converging bore through which the first fluid is accelerated. Additionally, the second fluid flow conduit may include a nozzle portion having a converging bore, a duct portion having a generally cylindrical bore, and a diffuser portion having a diverging bore. The nozzle portion of the second fluid flow conduit is mounted with respect to the nozzle portion of the first fluid flow conduit such that a generally annular port is formed through which the second fluid passes to mix with the first fluid. Additional mixing occurs in the duct portion and the diffuser portion.

The first flow conduit may be sufficiently configured for attachment to a tailpipe of the vehicular exhaust system. In this configuration the first fluid is exhaust gas and said second fluid is ambient air, such that the ambient air operates to cool the exhaust gas as it passes through the fluid entrainment apparatus. A vehicular exhaust system incorporating the disclosed fluid entrainment apparatus is also provided.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
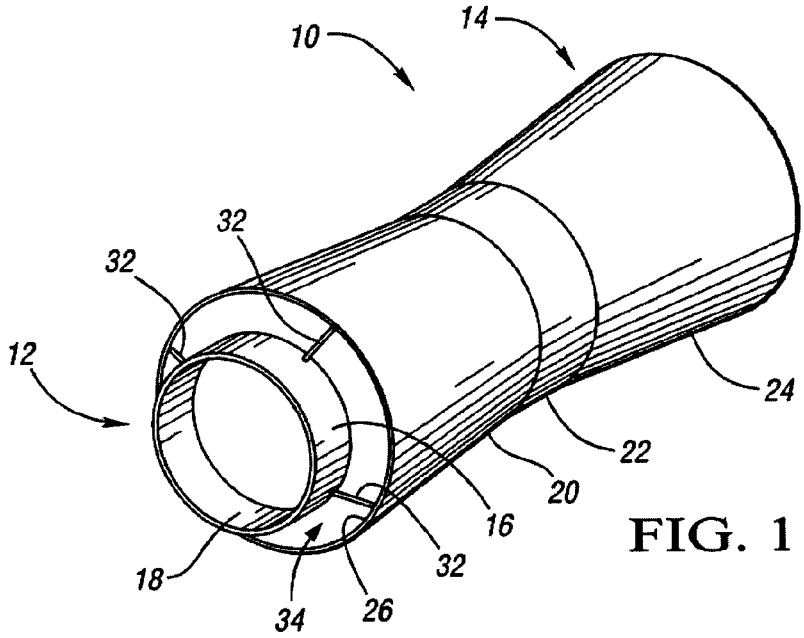
FIG. 1 is a schematic perspective view of a fluid entrainment apparatus consistent with the present invention.

Referring to the figures wherein like reference numbers represent like characters, there is shown in FIG. 1 a fluid entrainment apparatus 10 having a first fluid flow conduit 12 and a second fluid flow conduit 14. The first fluid flow conduit 12 includes a nozzle portion 16 having a generally frusto-conical shape, thereby defining a generally converging bore 18 through which a first fluid may flow.

The second fluid flow conduit 14 includes a nozzle portion 20, duct portion 22, and diffuser portion 24. The nozzle portion 20 has a generally frusto-conical shape, thereby defining a generally converging bore 26. The duct portion 22 is generally cylindrical in shape and defines a generally cylindrical bore 28, shown in FIG. 2. The diffuser portion 24 has a generally frusto-conical shape, thereby defining a generally diverging bore 30, shown in FIG. 2. The nozzle portion 16 and the nozzle portion 20 are spaced concentrically from one another by a plurality of gussets 32. The nozzle portion 16 and the nozzle portion 20 cooperate to form a generally annular orifice or port 34 through which a second fluid may flow. The first and second fluid may be the same fluid or different fluids. Those skilled in the art will recognize that various other methods of attaching the nozzle portion 16 to the nozzle portion 20 may be employed while remaining within the scope of that which is claimed, such as straps, brackets, posts, etc.

In its simplest form, the fluid entrainment apparatus 10 can include the first fluid flow conduit 12 discharging a first fluid into the second fluid flow conduit 14. The first fluid flow conduit 12 and the second fluid flow conduit 14 cooperate to form the orifice or port 34 through which a second fluid may flow and operates to influence the mass flow rate of the second fluid. Those skilled in the art will recognize that the cross-sectional shape of the first and second fluid flow conduits 12 and 14 may be of any shape such as, for example, oval, square, rectangular, etc, while remaining within the scope of that which is claimed.

Figure 2:
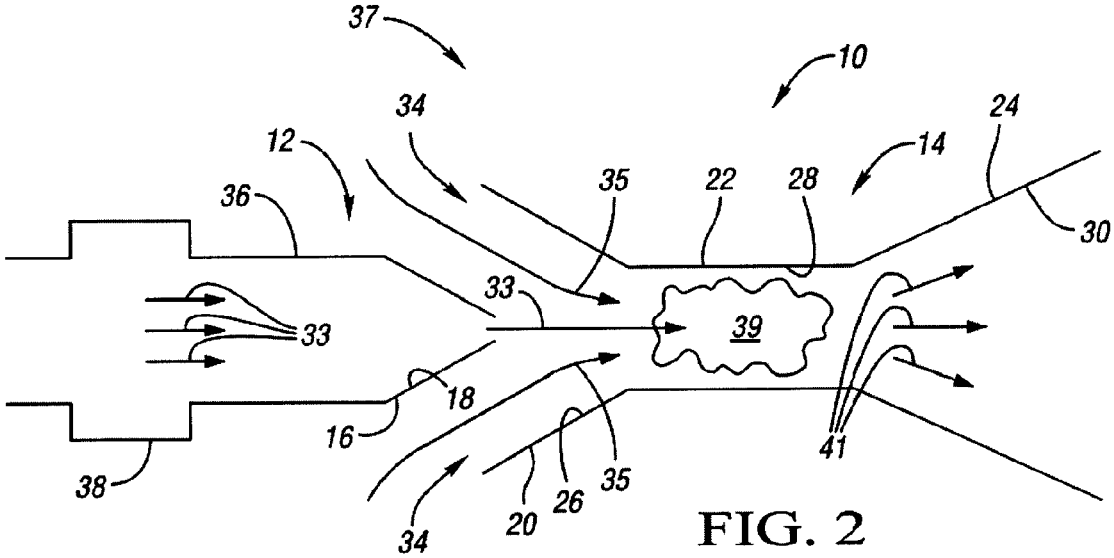
FIG. 2 is a schematic diagrammatic cross-sectional view of the fluid entrainment apparatus shown in FIG. 1.

Referring now to FIG. 2, there is shown a schematic diagrammatic cross-sectional view of the fluid entrainment apparatus 10. The fluid entrainment apparatus 10 may be installed near a tailpipe 36 of a vehicular exhaust system 37. In this application, the fluid entrainment apparatus 10 operates to cool the exhaust stream 33 flowing through the tailpipe 36 by the entrainment of an ambient air stream 35. The cooling of the exhaust stream 33 is often desired when there is an emission control device such as a diesel particulate filter, or DPF, 38 mounted upstream of the tailpipe 36. To maintain efficiency, the DPF 38 must periodically regenerate by oxidizing and burning of the accumulated soot or particulate matter contained within the DPF 38. In doing so, the temperature of the exhaust stream 33 exiting the tailpipe 36 increases.

As the higher temperature exhaust stream 33 flows from the tailpipe 36 into the nozzle portion 16, the reduction in cross-sectional area due to the converging bore 18 causes the speed of the exhaust stream 33 to increase. By accelerating the exhaust stream 33, an increased amount of ambient air 35 can enter the fluid entrainment apparatus 10 through the annular port 34. The ambient air stream 35 partially mixes, shown at 39, with the exhaust stream 33 in the nozzle portion 20. The combined ambient air stream and the exhaust stream 41 then flows to the duct portion 22 where further mixing occurs. At the exit of the duct portion 22, the combined ambient air stream and exhaust gas stream 41 enter the diffuser portion 24 and continue to mix while decelerating as a result of the increasing cross-sectional area of the diverging bore 30. The diffuser portion 24 partially compensates for the pressure drop across the fluid entrainment apparatus 10 when high exhaust stream gas flow is present, such as at high load engine operating conditions. By entraining an ambient air stream 35 into the exhaust stream 33, the temperature of the exhaust stream 33 may be reduced.

The principle under which the fluid entrainment apparatus 10 operates is that a faster moving fluid, i.e., the exhaust stream 33, entrains or draws along a slower moving fluid, i.e. the ambient air stream 35. In the fluid entrainment apparatus 10, shown in FIG. 2, the exhaust gas stream 33 flows along the central axis of the fluid entrainment apparatus 10 surrounded by a relatively slower moving ambient air stream 35, which is entrained through the annular port 34. High radial velocity gradients tend to form at the generally annular boundary between the ambient air stream 35 and the exhaust stream 33, thereby enhancing the entrainment rate of the ambient air stream 35 and improving the mixing between the ambient air stream 35 and the exhaust stream 33.

The dimensions of an exemplary fluid entrainment apparatus 10 for a vehicle exhaust system 37 include a nozzle portion 16 having an upstream opening of four inches in diameter that gradually tapers to a three inch diameter downstream opening over an axial length of two inches. Alternately, for vehicles with a tailpipe 36 diameter of 3.5 inches, an upstream opening of 3.5 inches in diameter that gradually tapers to a three inch diameter downstream opening over an axial length of one inch is appropriate. The nozzle portion 20, of this exemplary embodiment, will have an upstream opening of five inches in diameter and a downstream opening of four inches in diameter over an axial length of nine inches. The duct portion 22 will have a continuous inside diameter of four inches over a two inch axial length. The diffuser portion 24 has an upstream opening of four inches in diameter and a downstream opening of five inches in diameter over an axial length of nine inches. Additionally, the nozzle portion 20 and the nozzle portion 16 may be spaced axially away from each other to increase the mass flow rate of ambient air stream 35 through the annular port 34. As discussed hereinabove, the various design attributes of the fluid entrainment apparatus 10, shown in FIGS. 1 and 2, include the upstream opening diameter and axial length of the nozzle portion 16, the upstream opening diameter and axial length of the nozzle portion 20, the internal diameter and axial length of the duct portion 22, and the downstream opening diameter and axial length of the diffuser portion 24.

Those skilled in the art will recognize that the dimensions given above are only exemplary in nature and are in no way intended to limit the scope of that which is claimed. Those skilled in the art will recognize that the dimensions stated above may be varied to balance the entrainment of the ambient air with packaging constraints, exhaust backpressure constraints, pass-by noise requirements, mixing efficiency of the exhaust and ambient air streams and various other design constraints of the fluid entrainment apparatus 10. Additionally, although the above exemplary fluid entrainment apparatus 10 has a generally circular cross section for the first and second fluid flow conduit 12 and 14, respectively, those skilled in the art will recognize other cross sections that may be appropriate, such as box sections and oval sections.

Figure 3:
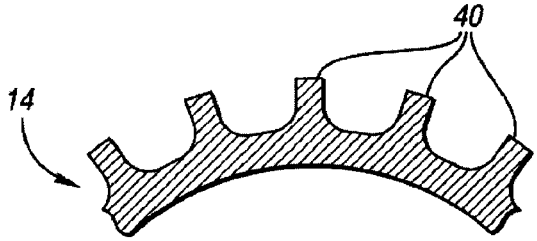
FIG. 3 is a partial cross-sectional view of an embodiment of a second fluid flow conduit for the fluid entrainment apparatus shown in FIGS. 1 and 2, illustrating a cooling fin arrangement.

In FIG. 3 there is shown a portion of a cross section of the second fluid flow conduit 14 illustrating a plurality of generally outwardly radiating cooling fins 40 disposed about the periphery of the second fluid flow conduit 14. The cooling fins 40 operate to increase the heat transfer from the fluid entrainment apparatus 10 to the atmosphere. The cooling fins 40 may vary in size, number, and shape as a result of design considerations. That is, the cooling fins 40 may have any shape or configuration while remaining within the scope of that which is claimed. The cooling fins 40 operate to increase the thermal performance of the fluid entrainment apparatus 10; however, those skilled in the art will recognize that the cooling fins 40 are not a necessary element for the proper functioning of the fluid entrainment apparatus 10. Additionally, the emissivity of the outer surface of the second fluid flow conduit 14 may be enhanced to improve radiation heat transfer to the atmosphere. Noise absorbers may be provided on the second fluid flow conduit 14 to reduce the noise emissions of the fluid entrainment apparatus 10.

Figure 4:
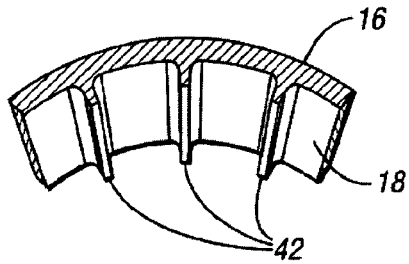
FIG. 4 is a partial cross-sectional perspective view of an embodiment of a nozzle portion for the fluid entrainment apparatus shown in FIGS. 1 and 2, illustrating a flow vane arrangement.

FIG. 4 illustrates a partial cross section of the nozzle portion 16 having a plurality of radially inwardly projecting flow vanes 42 disposed on the converging bore 18. The flow vanes 42 may be oriented parallel to the flow stream of the first fluid such as, for example, the exhaust stream 33 discussed hereinbefore. Similarly, the flow vanes 42 to may oriented at a predetermined angle to the flow stream of the first fluid to induce motion thereby increasing the mixing effectiveness within the second fluid flow conduit 14. Additionally, flow vanes 42 may be placed within the converging bore 26, near the annular port 34, to induce motion of the second fluid, thereby increasing to the mixing of the two fluids. Likewise, the flow vanes 42 may be disposed on the cylindrical bore 28 of the duct portion 22 and/or the diverging bore 30 of the diffuser portion 24 to induce fluid motion. The flow vanes 42 may vary in size, number, and shape as a result of design considerations. That is, the flow vanes 42 may have any shape or configuration while remaining within the scope of that which is claimed. The flow vanes 42 operate to increase the performance of the fluid entrainment apparatus 10; however, those skilled in the art will recognize that the flow vanes 42 are not a necessary element for the proper functioning of the fluid entrainment apparatus 10.

Although the function of the fluid entrainment apparatus 10 has been discussed with reference to the vehicular exhaust system 37, those skilled in the art will recognize that the fluid entrainment apparatus 10 may be used in other applications involving both gaseous and liquid flows. Additionally, the fluid entrainment apparatus 10 may be viewed as both a heater and a cooler depending on the desired function of the fluid entrainment apparatus 10.

While the best modes for carrying out the invention have been described in detail, those familiar with the art to which this invention relates will recognize various alternative designs and embodiments for practicing the invention within the scope of the appended claims.

The invention claimed is:

1. A fluid entrainment apparatus for a vehicular exhaust system comprising:

a first fluid flow conduit through which a first fluid flows;

a second fluid flow conduit spaced from said first fluid flow conduit such that a port is formed between said first and second fluid flow conduits through which a second fluid flows;

wherein said second fluid flow conduit includes a nozzle portion having a generally converging bore, a duct portion having a generally cylindrical bore, and a diffuser portion having a generally diverging bore and wherein said nozzle portion of said second fluid flow conduit is mounted with respect to a nozzle portion of said first fluid flow conduit to form said port;

wherein at least one of said nozzle portion of said second fluid flow conduit, said duct portion, and said diffuser portion includes a plurality of generally inwardly projecting flow vanes; and wherein said first fluid and said second fluid mix in said second fluid flow conduit.

2. The fluid entrainment apparatus of claim 1, wherein said first flow conduit is sufficiently configured for attachment to a tailpipe of the vehicular exhaust system and wherein said first fluid is exhaust gas and said second fluid is ambient air.

3. The fluid entrainment apparatus of claim 1, wherein said second fluid flow conduit has a plurality of cooling fins disposed thereon, said plurality of cooling fins being operable to improve the heat transfer effectiveness of the fluid entrainment apparatus.

4. The fluid entrainment apparatus of claim 1, wherein said nozzle portion of said first fluid flow conduit includes a generally converging bore.

5. The fluid entrainment apparatus of claim 4, wherein said nozzle portion of said first fluid flow conduit includes a plurality of generally inwardly projecting flow vanes.

6. A fluid entrainment apparatus comprising:

a first fluid flow conduit including a nozzle portion having a generally converging bore through which a first fluid flows;

a second fluid flow conduit having a nozzle portion having a generally converging bore, a duct portion having a generally cylindrical bore, and a diffuser portion having a generally diverging bore, wherein said nozzle portion of said second fluid flow conduit is mounted with respect to said nozzle portion of said first fluid flow conduit such that a generally annular port is formed through which a second fluid flows;

wherein at least one of said nozzle portion, said duct portion, and said diffuser portion of said second fluid flow conduit includes a plurality of generally inwardly projecting flow vanes; and wherein said first fluid and said second fluid mix in said second fluid flow conduit.

7. The fluid entrainment apparatus of claim 6, wherein said nozzle portion of said first flow conduit is sufficiently configured for attachment to a tailpipe of a vehicular exhaust system, said first fluid being exhaust gas and said second fluid being ambient air operable to cool said exhaust gas.

8. The fluid entrainment apparatus of claim 6, wherein said second fluid flow conduit has a plurality of cooling fins disposed thereon, said plurality of cooling fins being operable to improve the heat transfer effectiveness of the fluid entrainment apparatus.

9. The fluid entrainment apparatus of claim 6, wherein said nozzle portion of said first fluid flow conduit includes a plurality of generally inwardly projecting flow vanes.

10. An exhaust system for a vehicle comprising:

a tailpipe;

a fluid entrainment apparatus mounted to said tailpipe including:

a first fluid flow conduit, sufficiently configured for attachment to a said tailpipe, through which exhaust gas flows;

a second fluid flow conduit coaxially spaced from said first fluid flow conduit such that a port is formed through which ambient air flows;

wherein said first fluid flow conduit includes a nozzle portion having a generally converging bore;

wherein said second fluid flow conduit includes a nozzle portion having a generally converging bore, a duct portion having a generally cylindrical bore, and a diffuser portion having a generally diverging bore;

wherein at least one of said nozzle portion of said second fluid flow conduit, said duct portion, and said diffuser portion includes a plurality of generally inwardly projecting flow vanes; and wherein said exhaust gas and said ambient air mix in said second fluid flow conduit.

11. The exhaust system of claim 10, wherein said second fluid flow conduit has a plurality of cooling fins disposed thereon, said plurality of cooling fins being operable to improve the heat transfer effectiveness of the fluid entrainment apparatus.

12. The exhaust system of claim 10, wherein said nozzle portion of said first fluid flow conduit includes a plurality of generally inwardly projecting flow vanes.

* * * * *